US007393001B2

(12) United States Patent
Rott et al.

(10) Patent No.: US 7,393,001 B2
(45) Date of Patent: Jul. 1, 2008

(54) MULTILAYER FILM FOR CONSTRUCTING SKIS

(75) Inventors: Stefan Rott, Weissenburg (DE); Andreas Hirschfelder, Fürth (DE); Adalbert Loidl, Palling (DE)

(73) Assignees: Leonhard Kurz GmbH & Co., KG, Furth (DE); CPS GmbH, Zell am See (AT)

( * ) Notice: Subject to any disclaimer, the term of this patent is extended or adjusted under 35 U.S.C. 154(b) by 278 days.

(21) Appl. No.: 10/524,328

(22) PCT Filed: Aug. 9, 2003

(86) PCT No.: PCT/DE03/02691

§ 371 (c)(1),
(2), (4) Date: Aug. 10, 2005

(87) PCT Pub. No.: WO2004/020054

PCT Pub. Date: Mar. 11, 2004

(65) Prior Publication Data

US 2006/0119077 A1 Jun. 8, 2006

(30) Foreign Application Priority Data

Aug. 13, 2002 (DE) ..... 102 36 959

(51) Int. Cl.

| | |
|---|---|
| ***A63C 5/00*** | (2006.01) |
| ***A63C 5/14*** | (2006.01) |
| ***A63C 5/12*** | (2006.01) |
| ***A63C 5/056*** | (2006.01) |
| ***A63C 5/04*** | (2006.01) |

(52) U.S. Cl. ..... 280/610; 280/601; 280/602

(58) Field of Classification Search ..... 280/601, 280/602, 610
See application file for complete search history.

(56) References Cited

U.S. PATENT DOCUMENTS

| | | | | |
|---|---|---|---|---|
| 2,858,248 | A * | 10/1958 | Hastings, III et al. | 428/336 |
| 4,639,009 | A * | 1/1987 | Meatto et al. | 280/602 |
| 4,671,529 | A * | 6/1987 | LeGrand et al. | 280/610 |

(Continued)

FOREIGN PATENT DOCUMENTS

| | | |
|---|---|---|
| DE | 37 38 040 A1 | 8/1988 |

(Continued)

OTHER PUBLICATIONS

Phillipe et al., Japanese unexamined patent publication No. 6-154385, *Patent Abstracts of Japan*, Jun. 3, 1994.

(Continued)

*Primary Examiner*—Christopher Ellis
*Assistant Examiner*—John R Olszewski
(74) *Attorney, Agent, or Firm*—Hoffmann & Baron, LLP

(57) ABSTRACT

The invention concerns a multilayer film (15) for the construction of skis, a ski (1) having said multilayer film (15) and processes for the production of the multilayer film and the ski. The multilayer film (15) has a multilayer transfer or laminating film comprising two or more thin layers. A mechanically load-bearing layer with preferably a high modulus of elasticity is arranged on a surface of the multilayer transfer or laminating film. A cover layer is arranged on another surface of the multilayer transfer or laminating film. The multilayer film formed in that way is now applied to a base body of the ski (1).

30 Claims, 2 Drawing Sheets

U.S. PATENT DOCUMENTS

| | | | | | |
|---|---|---|---|---|---|
| 5,057,170 | A | * | 10/1991 | Legrand et al. | 156/73.5 |
| 5,288,097 | A | * | 2/1994 | Pascal et al. | 280/610 |
| 5,372,370 | A | | 12/1994 | Rohrmoser | |
| 5,437,755 | A | * | 8/1995 | Lavorel et al. | 156/240 |
| 5,492,370 | A | * | 2/1996 | Chatwin et al. | 283/110 |
| 5,589,275 | A | * | 12/1996 | Breitler et al. | 428/458 |
| 5,591,509 | A | * | 1/1997 | Lorenz et al. | 428/107 |
| 5,690,349 | A | * | 11/1997 | Rohrmoser | 280/610 |
| 5,944,335 | A | * | 8/1999 | Riepler | 280/602 |
| 6,008,581 | A | * | 12/1999 | Ochiai et al. | 313/582 |
| 6,210,777 | B1 | * | 4/2001 | Vermeulen et al. | 428/195.1 |
| 6,293,567 | B1 | * | 9/2001 | Menges | 280/14.21 |

FOREIGN PATENT DOCUMENTS

| | | | |
|---|---|---|---|
| DE | 43 22 300 | A1 | 1/1994 |
| DE | 696 14 222 | T2 | 5/1997 |
| WO | WO 02/28491 | A1 | 4/2002 |

OTHER PUBLICATIONS

Katsuyki et al., Japanese unexamined patent publication No. 8-310170, *Patent Abstracts of Japan*, Nov. 26, 1996.

Seishi et al., Japanese unexamined patent publication No. 8-090999, *Patent Abstracts of Japan*, Apr. 9, 1996.

Takashi et al., Japanese unexamined patent publication No. 7-001825, *Patent Abstracts of Japan*, Jan. 6, 1995.

Mamoru, Japanese unexamined patent publication No. 9-122574, *Patent Abstracts of Japan*, May 13, 1997.

Pierre-Yves et al., Japanese unexamined patent publication No. 6-225957, *Patent Abstracts of Japan*, Aug. 16, 1994.

Atsushi, Japanese unexamined patent publication No. 7-081206, *Patent Abstracts of Japan*, Mar. 28, 1995.

Gilles et al., Japanese unexamined patent publication No. 1-284272, *Patent Abstracts of Japan*, Nov. 15, 1989.

* cited by examiner

MULTILAYER FILM FOR CONSTRUCTING SKIS

This application claims priority based on an International Application filed under the Patent Cooperation Treaty, PCT/DE03/02691, filed on Aug. 9, 2003, and German Patent Application No. 102 36 959.3-15, filed on Aug. 13, 2002.

BACKGROUND OF THE INVENTION

The invention concerns a multilayer film for constructing skis, in particular for application to a ski base body of an alpine ski, a water ski, a wakeboard, a kiteboard, a surfboard or a snowboard, a ski, in particular an alpine ski or a snowboard, a process for the production of a multilayer film for the construction of skis, and a process for the production of a ski.

In the production of skis, it has proven to be advantageous to apply to the actual base body of the ski thin metal layers which on the one hand as a structural component improve the skiing characteristics of the ski and on the other hand also afford visually attractive creative design options.

The invention is now based on a configuration of a ski, as is described in WO 2/28491 A1.

In order to improve torsional resistance, the desired distribution of weight and the desired flexural characteristic, it is proposed that a thin metal layer is applied to the top side of the ski.

The ski comprises a base body which is formed from a piece of wood and a plurality of elements which are applied to that base body. The underside of the base body has a thin metal layer and at the sides two steel edge elements. Disposed beneath the metal layer is a sole or running surface made from a plastic material. Applied to the surface of the base body is a connecting layer which comprises a glass fiber cloth and which is glued by means of a resin to the metal layer disposed thereover and to the base body. Graphic elements can then be applied to the metal layer.

The metal layers comprise steel, aluminum, aluminum alloys or titanium. The thickness of the metal layers is between 0.008 inch and 0.02 inch.

The procedure involved in production of the ski is as follows: the metal layer is glued by means of connecting strips to side portions. The connecting layer impregnated with resin is applied to the base body. As already described above the connecting layer provided in that way has adhesive properties. Now the prefabricated element consisting of the metal layer, the side portions and the connecting strips is applied to the connecting layer and pressure applied thereto by means of a mold so that the prefabricated element is joined to the base body by the connecting layer.

SUMMARY OF THE INVENTION

Now, the object of the invention is to improve the production of skis, in particular alpine skis and snowboards.

That object is attained by a multilayer film for the construction of skis, having a multilayer transfer or laminating film comprising two or more thin layers and on the one surface of which is arranged a mechanically load-bearing layer with preferably a high modulus of elasticity and on the other surface of which is arranged a cover layer. The invention further concerns a ski, in particular an alpine ski or a snowboard, in which such a multilayer film is applied to a ski base body. The invention further concerns a process for the production of a multilayer film for the construction of skis, wherein a multilayer transfer or laminating film comprising two or more thin layers is applied to a surface of a mechanically load-bearing layer with a high modulus of elasticity and wherein a cover layer is applied to a surface of the multilayer transfer or laminating film, which is in opposite relationship to the mechanically load-bearing layer. The invention further concerns a process for the production of a ski, wherein a multilayer film as described hereinbefore is applied to a ski base body.

The term transfer or laminating film in accordance with the invention is used to denote the functional film body of a transfer or laminating film, which does not include a backing or carrier film which is possibly used for production of or for the application of such a transfer or laminating film to an article (and which thereafter is usually removed, at least in the case of transfer films). The term ski in accordance with the invention is used to denote all possible kinds of skis, for example alpine skis, cross-country skis, snowboards, water skis, wakeboards, kiteboards or surfboards.

The invention affords the advantage that many different visual creative design options are afforded, while maintaining a high functional standard. The decoration process is simplified, and many different design elements can be incorporated without a high level of complication and expenditure. In addition the functional characteristics of the ski such as for example the above-described parameters of torsional resistance, desired distribution of weight and desired flexural characteristic are promoted by the multilayer film according to the invention.

A further advantage is that the production process for the production of skis of a graphically attractive configuration is speeded up and reduced in cost.

A further advantage is that the graphic design elements of the ski are maintained over a long period even with intensive use, which cannot be attained by the hitherto usual processes.

Advantageous configurations of the invention are set forth in the appendant claims.

It is desirable for the transfer or laminating film used to be in the form of a transfer film which has an adhesive layer, a functional layer and a release layer. The adhesive layer serve for glueing the film structure to the mechanically load-bearing layer. The release layer is advantageously made up of a layer which permits good adhesive bonding to the cover layer. Thus the release layer used can be a clear lacquer layer which ensures excellent bonding, particularly when the cover layer used is a PMMA layer or PC layer (PMMA=polymethylmethacrylate, PC=polycarbonate) or also a layer of ABS or ABS blends.

The functional layer can be made up of one or more layers. Design options for the ski, which are particularly full of effect, can be afforded if one or more of the following layers is or are used as a functional layer alone or in combination:

A metal layer, a thin film layer succession which produces color shifts by means of interference, a replication layer into which diffractive structures or macrostructures are embossed and which is combined with a metal layer and/or an HRI layer or an LRI layer (HRI=high refraction index; LRI=low refraction index), or a color lacquer layer.

A color lacquer layer guarantees good visuals and shine. A meal layer in combination with a decoration print can serve as a further design element. By means of a metal layer, it is possible to achieve a metal visual look, in which respect further visually quite attractive elements are achieved if a colored metal is used or if a colored lacquer layer is arranged in front of the metal layer.

The use of thin film layer successions makes it possible to produce color shifts which are dependent on the viewing angle and which, depending on the respective viewing angle involved, can impart a different appearance to the ski. If a replication layer with diffractive structures is used, then it is possible for example to use hologram representations as further design elements.

It is advantageous if a thermoformable, in particular deep-drawable film is used as the transfer or laminating film. In that way it is possible for the ski production process to be made still more efficient.

In order to guarantee the functional characteristics of the ski and to satisfy the mechanical, chemical and climatic demands of a ski, it is advantageous for the cover layer and the mechanically load-bearing layer to be shaped thicker than the transfer or laminating film, preferably in each case at least 5× thicker than the transfer or laminating film. Advantageous thickness ranges for the cover layer are in a range of between 50 and 125 μm. Advantageous thickness ranges for the mechanically load-bearing layer are in the range of between 100 μm and 2 mm.

Depending on the respective manner in which the multilayer film is joined to the base body of the ski, it is advantageous for the mechanically load-bearing layer or the cover layer to be of an embossed or structured nature. Such a configuration on the one hand promotes the functional properties and characteristics and on the other hand can also serve as an attractive optical creative design element.

It is further desirable for the mechanically load-bearing layer and/or the cover layer to be transparent. In that respect it is in particular advantageous for both layers to be transparent. The film can thus be used 'double-sided', which expands its area of use.

It has proven to be advantageous for the cover layer to be made from thermoplastic material or from a screen printing ink or a casting lacquer. That guarantees good mechanical and chemical resistance. In addition that ensures good adhesion to the subjacent layers.

Further design options are afforded if additional decorations are printed on the multilayer transfer or laminating film prior to the application of further layers.

Depending on the respectively desired functional characteristics the mechanically load-bearing layer of the multilayer film or the cover layer of the multilayer film can be joined to the ski base body. If the cover layer is joined to the ski base body, then in general the scratch resistance of the decorative elements is enhanced by virtue of the generally greater layer thickness of the mechanically load-bearing layer.

BRIEF DESCRIPTION OF THE DRAWINGS

The invention is described by way of example hereinafter by means of a number of embodiments with reference to the accompanying drawings in which.

DESCRIPTION OF THE PREFERRED EMBODIMENTS

Figure 1:
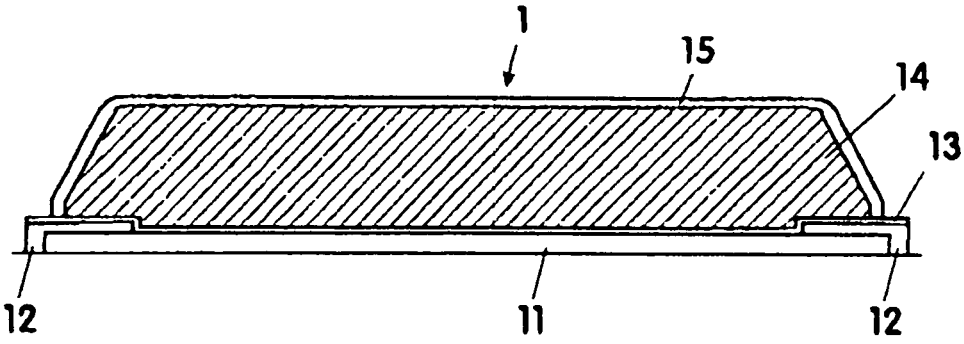
FIG. 1 is a view in section through a ski designed in accordance with the invention.

FIG. 1 shows an alpine ski 1. The ski has two edge elements 12, a sole or running surface element 11, a metal layer 13, a ski base body 14 and a multilayer film 15.

The running surface element 11 is made from a plastic material. The edge elements 12 comprise steel. They are shaped in the usual form to perform the function of a steel edge of an alpine ski. The metal layer 13 preferably comprises a high-strength steel, a high-strength aluminum alloy or titanium. The thickness of the metal layer 13 is preferably between 0.25 and 0.5 mm. The ski base body 14 comprises wood.

It is however also possible for the ski base body 14 to comprise another material, for example a plastic material. In addition it is possible for the ski base body 14 to be made up of a plurality of layers. It comprises for example a wood core which is sheathed by a glass fiber cloth. It is possible for that sheathing not to embrace the entire surface of the wood core and thus to be an only partial enclosure.

It is further possible for the ski base body to be made up of a surface of thermoplastic material with a subjacent upper web of glass fiber cloths or laminates, possibly in combination with a layer of Titanal. Those layers are applied either to a wood core or to a PU injection molded foam core.

The multilayer film 15 is so shaped that it covers the side surfaces of the ski base body 14 and the side of the ski base body 14, which is in opposite relationship to the sole running surface of the alpine ski 1. The multilayer film 15 is preferably of a thickness of between 0.25 and 2 mm. It is also possible for the multilayer film 15 to be of a planar form and thus for example to be applied only to the side in opposite relationship to the sole running surface or to the side surfaces of the ski base body 14. It is further possible for the multilayer film 15 to completely enclose the ski base body 14.

The multilayer film 15 is preferably put into the appropriate shape by means of a thermoforming process and is then adhesively secured to the ski base body 14. It is however also possible for the multilayer film 15 to be pressed on to the ski base body 14 and, in that pressing operation, the film 15 acquires the shape shown in FIG. 1 and at the same time is glued to the ski base body 14.

The precise structure of the multilayer film 15 will now be described in greater detail with reference to FIGS. 2 and 3 which each disclose the structure of a film which can be used as the multilayer film 15.

Figure 2:
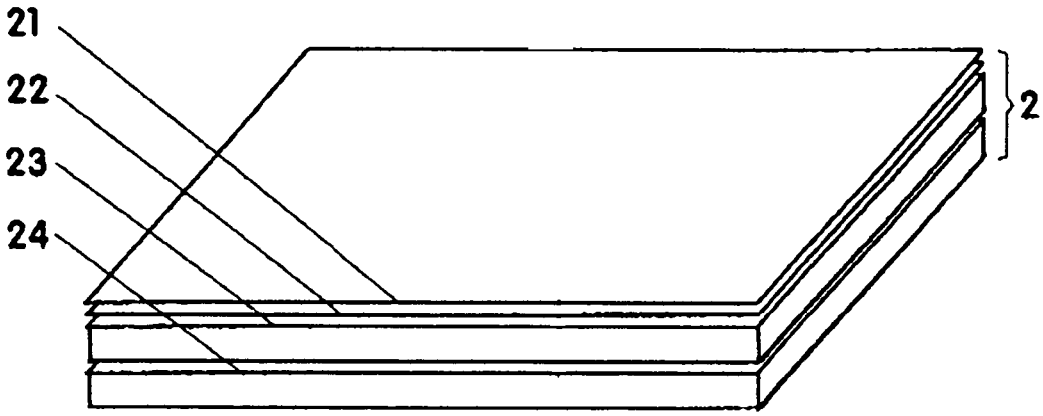
FIG. 2 is a diagrammatic view of the structure of a multilayer film according to the invention for a first embodiment.

FIG. 2 shows a multilayer film 2 which has a mechanically load-bearing layer 24, a multilayer transfer or laminating film 23 comprising two or more thin layers, and two cover layers 21 and 22.

The mechanically load-bearing layer 24 comprises a thermoplastic material having a high modulus of elasticity. In this case the modulus of elasticity of the mechanically load-bearing layer 24 is preferably in the range of between 800 and 2500 Mpa. The plastic materials used can be in particular styrene polymers such as for example ABS (ABS=acrylonitrile/butadiene/styrene), M-ABS+TPU (TPU=thermoplastic elastomers based on polyurethane), ABS+PC (PC=polycarbonate) as well as polyurethanes such as in particular TPU. It is further possible to use PC plastic materials or PS plastic materials (PC=polycarbonate, PS=polystyrene). The thickness of the mechanically load-bearing layer is preferably between 100 μm and 2 mm. In the preferred embodiment shown in FIG. 2 the thickness of the mechanically load-bearing layer 24 is 1.8 mm.

The transfer or laminating film 23 comprises a VF chromium film (VF=vacuum formable). The thickness of the VF chromium film used is about 5 μm. It comprises four layers. On the one hand, a release layer formed by a clear lacquer layer (polyacrylate) of about 2 μm in thickness. In addition, a functional layer which is formed by a layer about 1 μm in thickness, comprising a lacquer suitable for vapor deposition and a thin, vapor-deposited chromium layer. Instead of a chromium layer it is also possible to use other metal layers. Finally an adhesive layer of about 2 μm in thickness is applied.

In that respect it is possible for an additional UV protection (for example cerium oxide, $TiO_2$, HALS and so forth) to be added to the release layer and/or the layer of vapor-depositable lacquer.

The transfer film 23 can additionally be printed upon using screen printing or additionally decorated using a thermotransfer process. It is further possible for the transfer film 23 to be printed upon by means of an intaglio printing process or a flexoprinting process or another usual printing process.

The cover layers 22 comprise a screen printing ink or a casting lacquer. In that respect preferably 2-component polyurethane inks are used as the screen printing inks and casting lacquers. It is also possible for the cover layer 22 to comprise a layer of thermoplastic material, for example PC plastic material (PC=polycarbonate), PMMA (polymethylmethacrylate) or ABS/TPU blends.

As shown in FIG. 2 it is also possible for two cover layers to be applied to the transfer film 23. Thus for example the layer 22 can be a colored layer which under some circumstances is shaped in a pattern configuration, comprising a screen printing ink or a casting lacquer. The layer 21 is a solution comprising a transparent casting lacquer, a transparent screen printing ink or a layer comprising a thermoplastic material, for example PMMA.

The thickness of the overall cover layer is preferably between 50 and 125 μm. In the embodiment illustrated in FIG. 2 the layer is of a thickness of 50 μm and the layer 21 is of a thickness of 70 μm.

The cover layer can be not only smooth but also of a structured nature. Equally the mechanically load-bearing layer can be smooth or structured, for example embossed, brushed and/or scratched.

When the multilayer film 2 is applied to a ski base body, the outside surface of the multilayer film 2, which is formed by the mechanically load-bearing layer 24, is joined to the ski base body.

Figure 3:
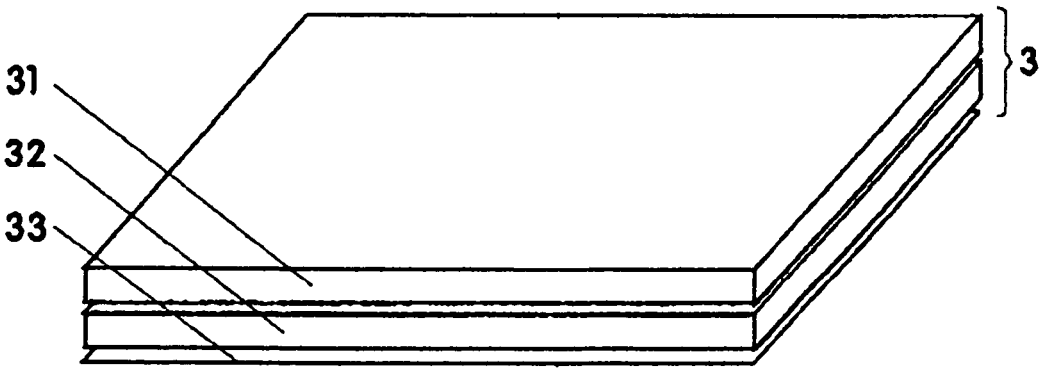
FIG. 3 is a diagrammatic view of the structure of a multilayer film according to the invention for a second embodiment.

FIG. 3 shows the structure of a multilayer film 3 which can also be applied as a multilayer film 15 to the ski base body 14.

The multilayer film 3 has a cover layer 33, a multilayer transfer or laminating film 32 and a mechanically load-bearing layer 31. When the multilayer film 3 is applied to the ski base body 14 in this embodiment the cover layer 33 is joined to the ski base body 14.

The mechanically load-bearing layer 31 is like the layer 24 shown in FIG. 2 and thus comprises a mechanically load-bearing thermoplastic layer of a plastic material with a high modulus of elasticity. The transfer or laminating film 32 is like the transfer or laminating film 23 shown in FIG. 2. The cover layer 33 involves a screen printing or casting lacquer layer which is like the corresponding layer shown in FIG. 2. It is also possible for the layer 33 to comprise a layer of printing ink.

The above-illustrated layer structure makes it possible for the individual layers of the multilayer film to be connected together without additional use of adhesive. The mechanically load-bearing layer is joined to the transfer film or laminating film by means of an extrusion process or a hot pressing or hot stamping process. In that case the mechanically load-bearing layer can be transparent or opaque. The cover layer is then applied, for example by means of a screen printing process. It is also possible to use other processes, for example dipping, spraying, flexoprinting, tampon printing, intaglio printing, offset printing and so forth.

Figure 4:
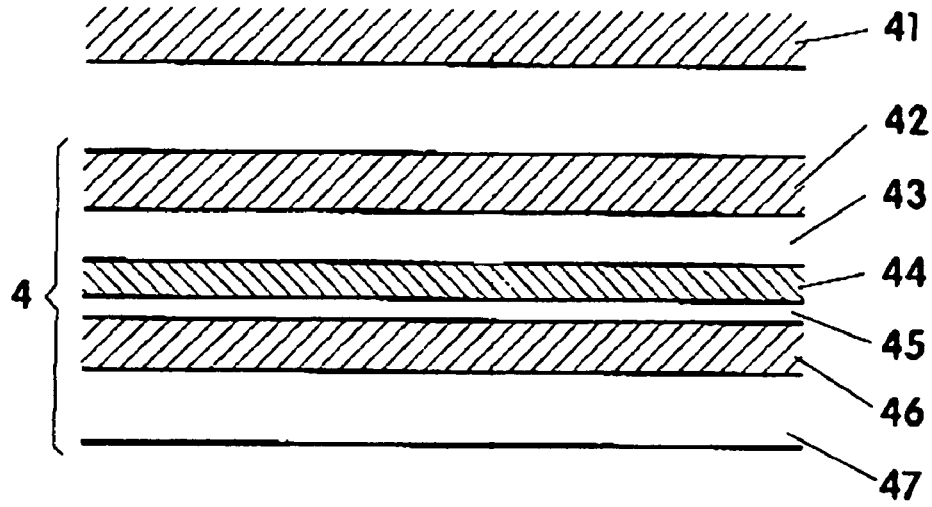
FIG. 4 shows a diagrammatic view of a transfer film which is used in a multilayer film according to the invention.

FIG. 4 now shows the structure of a transfer film which can be used for the transfer or laminating films 23 and 32.

FIG. 4 shows a transfer film 4 and a carrier 41. In this case the carrier 41 preferably comprises PET and is removed upon application of the transfer film 4 to the mechanically load-bearing layer of the multilayer film. The transfer film 4 has a release layer 42, a replication layer 43, two thin film layer successions 44 and 45, a metal layer 46 and an adhesive layer 47.

The release layer 42 serves to ensure that the transfer film 4 is released from the carrier 41 as well as possible. As already stated above, it is advantageous in that respect to use for the release layer 42 a material which ensures good adhesion of the cover layer of the multilayer film. That is achieved if a layer of polyacrylate is used as the release layer 42. The preferred thickness of the release layer 42 is in the region of between 1 and 3 μm.

The release layer 42 thus performs a double function, on the one hand as a release layer in order to ensure release of the multilayer film 4 from the carrier 41 and secondly as a bonding layer for the cover layer of the multilayer film.

The replication layer 43 preferably comprises a replication lacquer or a thermoplastic material. The thickness of the replication layer 43 is of the order of magnitude in the region of between 1 and 20 μm, preferably in the region of between 5 μm and 12 μm. Polycarbonates or polyacrylates can be used as thermoplastic materials for the replication layer 42.

One or more diffractive structures are embossed into the replication layer 43 by means of a transfer tool. Thus for example a hologram can be produced by that diffractive structure by optical-diffraction effects. It is further possible for macrostructures or symmetrical-achromatic structures or asymmetrical-achromatic structures such as for example blaze structures to be embossed. The application of a matt structure to the replication layer 43 is also possible.

The thin film layers 44 and 45 form a thin film layer succession, by means of which color shifts which are dependent on the angle of view can be produced. The layer 44 is an absorption layer formed for example by a very thin metal layer. The layer 45 is a spacer layer whose optical thickness corresponds to the $\lambda/4$- or the $\lambda/2$-condition. The resulting optical interference phenomena provide color shifts which are dependent on the angle of view, from the point of view of the viewer.

The absorption layer 43 is preferably applied by means of vacuum coating, for example by means of PVD (PVD=physical vapor deposition) or sputtering. The thickness of the absorption layer 43 is between approximately 30 and 150 Å. In this case the absorption layer is formed by a semi-opaque material, for example a chromium, nickel, titanium, vanadium, cobalt or palladium alloy. The semi-opaque material can also be formed by metal fluorides, metal oxides, metal sulfides or metal nitrides.

The spacer layer 44 comprises a transparent material. It can be in the form of a high-refraction layer (HRI=high refraction index) or a low-refraction layer (LRI=low refraction index). High-refraction materials which can be used are for example zinc sulfide (ZnS), zinc oxide (ZnO), zirconium oxide ($ZrO_2$), magnesium oxide (MgO) or silicon nitride ($Si_3N_4$). Materials which can be used for a low-refraction layer are for example silicon oxide ($SiO_x$), aluminum oxide ($Al_2O_3$) and metal fluorides such as for example magnesium fluoride ($MgF_2$).

It is also possible for the spacer layer 44 to be colored. It is further possible, instead of the two thin film layers 44 and 45, to arrange a thin film layer succession comprising a plurality of alternately arranged high-refraction and low-refraction thin film layers. It is also possible in that way to achieve color shifts which are dependent on the angle of view.

The metal layer 46 is formed for example by a chromium layer or an aluminum layer.

The adhesive layer 47 can be formed by an acryl-based polymer or the like.

Instead of using the transfer film 4 it is also possible to use a laminating film. In the case of such a laminating film the release layer 42 is replaced by a bonding layer which is of a configuration for example like the adhesive layer 47. The use of a laminating film makes it possible for a layer of thermoplastic material, which is used as a cover layer, to be joined to the laminating film without the application of an additional adhesive.

Figure 5:
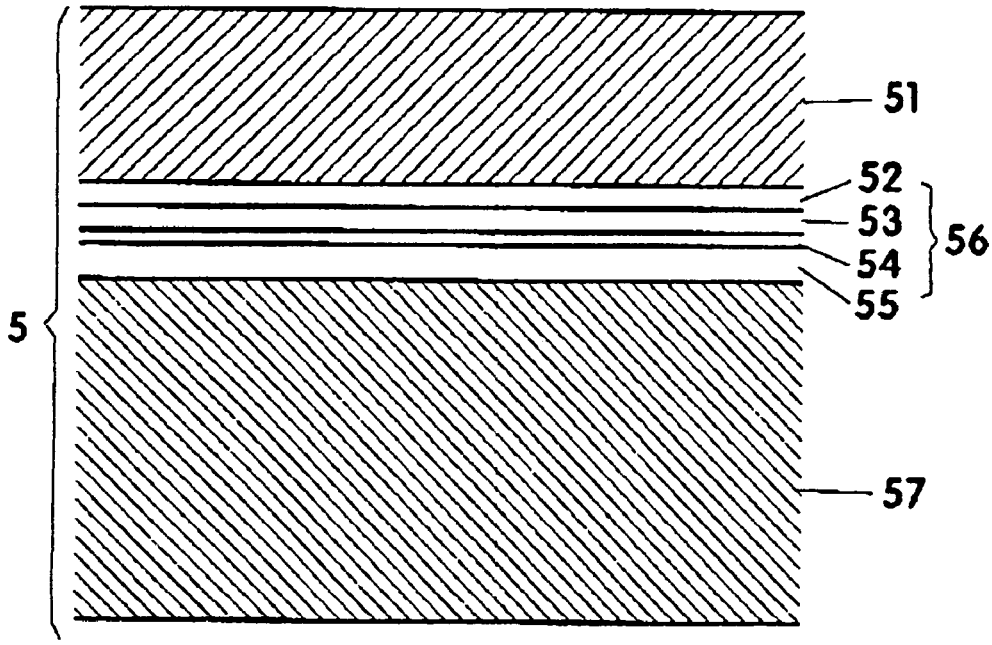
FIG. 5 shows a view in section through a multilayer film according to the invention.

FIG. 5 shows the structure of a multilayer film 5. The multilayer film 5 has a cover layer 51, a transfer film 56 and a mechanically load-bearing layer 57. The transfer film 56 has a release layer 52, a colored lacquer layer 53, a metal layer 54 and an adhesive layer 55.

The cover layer 51 comprises a layer of ABS/TPU blend of a thickness of 75 μm. The release layer 52 comprises a polyacrylate layer with a layer thickness of about 2 μm. The colored lacquer layer 53 comprises a vapor-depositable lacquer and is of a thickness of about 1 μm. The metal layer 54 comprises chromium and is about 10 nm in thickness. The adhesive layer 55 comprises a pressure-activatable adhesive and involves a layer thickness of about 2 μm. The mechanically load-bearing layer 57 comprises an ABS layer of a thickness of 100 μm, which preferably has a high modulus of elasticity.

The invention claimed is:

1. A multilayer film for the construction of skis, wherein the multilayer film comprises:

a multilayer transfer film or multilayer laminating film of a thickness of less than 125 μm and comprising two or more thin layers, a mechanically load-bearing layer is arranged on a surface of the multilayer transfer film or multilayer laminating film, and a cover layer is arranged on another surface of the multilayer transfer film or multilayer laminating film, wherein the cover layer and the mechanically load-bearing layer are each respectively thicker than the transfer or laminating film, wherein the cover layer is in particular of a thickness of between 50 and 125 μm and the mechanically load-bearing layer is in particular of a thickness of between 100 μm and 2 mm, and wherein the mechanically load-bearing layer is transparent and/or the cover layer is transparent.

2. A multilayer film as set forth in claim 1, wherein the multilayer transfer film or multilayer laminating film has an adhesive layer, a functional layer and a release layer.

3. A multilayer film as set forth in claim 2, wherein the release layer is a clear lacquer layer which acts as a bonding layer in relation to the cover layer.

4. A multilayer film as set forth in claim 2, wherein the functional layer has a metal layer.

5. A multilayer film as set forth in claim 2, wherein the functional layer has a thin film layer succession which produces color shifts by means of interference.

6. A multilayer film as set forth in claim 2, wherein the functional layer has a replication layer into which a diffractive structure or a macrostructure is embossed.

7. A multilayer film as set forth in claim 2, wherein the functional layer has an HRI layer.

8. A multilayer film as set forth in claim 2, wherein the functional layer comprises one or more decorative layers, which is/are visible through the cover layer and/or the mechanically load-bearing layer.

9. A multilayer film as set forth in claim 1, wherein the multilayer transfer film or multilayer laminating film is deep-drawable.

10. A multilayer film as set forth in claim 1, wherein the mechanically load-bearing structure is embossed or structured.

11. A multilayer film as set forth in claim 1, wherein the cover layer comprises a thermoplastic material.

12. A multilayer film as set forth in claim 1, wherein the cover layer comprises a printing ink or a lacquer.

13. A multilayer film as set forth in claim 1, wherein the cover layer is structured.

14. A multilayer film as set forth in claim 1, wherein additional decoration is printed on to the multilayer transfer film or multilayer laminating film.

15. A multilayer film as set forth in claim 1, wherein the multilayer film is shapeable by means of a thermoforming process.

16. A multilayer film as set forth in claim 1, wherein the multilayer transfer film or multilayer laminating film is deep-drawable and has an adhesive layer, a functional layer and a release layer, wherein the release layer is a clear lacquer layer which acts as a bonding layer in relation to the cover layer and wherein the functional layer composes one or more decorative layers, which is/are visible through the cover layer and/or the mechanically load bearing layer, wherein the cover layer and the mechanically load-bearing layer each comprise a thermoplastic material, and wherein the multilayer film is shapeable by means of a thermoforming process.

17. A multilayer film as set forth in claim 16, wherein the functional layer comprises a metal layer.

18. A multilayer film as set forth in claim 16, wherein the mechanically load-bearing layer has a high modulus of elasticity.

19. A multilayer film as set forth in claim 18, wherein the high modulus of elasticity is in the range of between 800 and 2500 MPa.

20. A ski having a ski base body comprising one or more layers and having a sole running surface, wherein a multilayer film as set forth in claim 16, which is shaped by means of a thermoforming process, is applied to the ski base body on the side of the ski in opposite relationship to the sole running surface of the ski and to the side surfaces of the ski base body.

21. A ski as set forth in claim 20, wherein the multilayer film shaped by means of a thermoforming process completely encloses the ski base body.

22. A ski as set forth in claim 20, wherein the ski is an alpine ski, water ski, wakeboard, kiteboard, surfboard or snowboard.

23. A multilayer film as set forth in claim 1, wherein the mechanically load-bearing layer has a high modulus of elasticity.

24. A multilayer film as set forth in claim 23, wherein the high modulus of elasticity is in the range of between 800 and 2500 MPa.

25. A ski having a ski base body comprising one or more layers and having a sole running surface, wherein a multilayer film as set forth in claim 1 is applied to the ski base body on the side of the ski in opposite relationship to the sole running surface of the ski.

26. A ski as set forth in claim 25, wherein the mechanically load-bearing layer is joined to the ski base body.

27. A ski as set forth in claim 25, wherein the cover layer is joined to the ski base body.

28. A ski as set forth in claim 25, wherein the cover layer is transparent and the mechanically load-bearing layer is joined to the ski base body.

29. A ski as set forth in claim 25, wherein the mechanically load-bearing layer is transparent and the cover layer is joined to the ski base body.

30. A ski as set forth in claim 25, wherein the ski is an alpine ski, water ski, wakeboard, kiteboard, surfboard or snowboard.

* * * * *